United States Patent [19]

Bridger

[11] 4,300,327

[45] Nov. 17, 1981

[54] BALE BAGGING APPARATUS

[75] Inventor: William L. Bridger, Fowler, Calif.

[73] Assignee: Future Packaging Machinery Co., Inc., Fresno, Calif.

[21] Appl. No.: 124,543

[22] Filed: Feb. 25, 1980

[51] Int. Cl.[3] ..... B65B 5/04

[52] U.S. Cl. ..... 53/258; 53/255

[58] Field of Search ..... 53/255, 258, 573

[56] References Cited

U.S. PATENT DOCUMENTS

| | | | |
|---|---|---|---|
| 231,215 | 8/1880 | Dederick | 53/258 |
| 2,885,850 | 5/1959 | Smith | 53/258 |
| 3,451,192 | 6/1969 | Irwin | 53/573 X |
| 3,503,180 | 3/1970 | Myles et al. | 53/258 |

*Primary Examiner*—Robert D. Baldwin

*Attorney, Agent, or Firm*—Huebner & Worrel

[57] ABSTRACT

A bale bagging apparatus for placing a bag having an open end and a closed end over an elongated bale transported transversely along a conveyor, the apparatus having a stop reciprocable toward and from the bale to retain the bale at a bagging station along the conveyor; an open ended sleeve adapted to receive the bag externally and to telescope over the bale, the sleeve reciprocating in a path which is normal to the conveyor and extends across the station from a bag receiving position to a stripped position; and elements for stopping movement of the bale along the conveyor when the bale is aligned with the sleeve, so that a stroke of the sleeve from the receiving position into the stripped position strips the bag from the sleeve over the bale.

8 Claims, 8 Drawing Figures

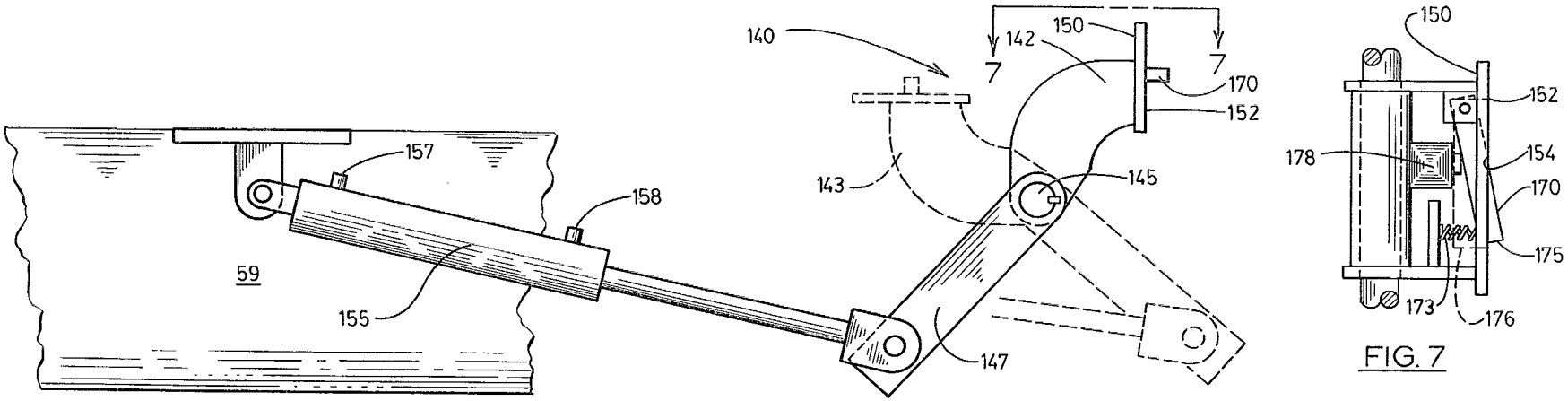
FIG. 7
FIG. 6
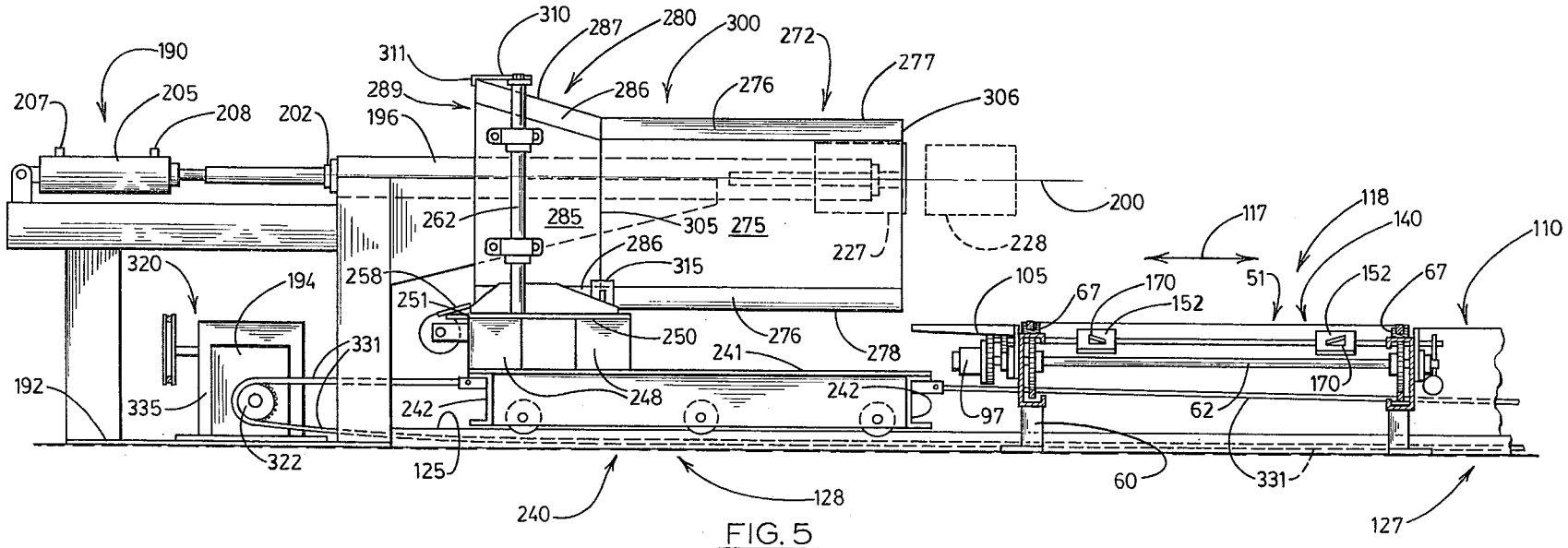
FIG. 5

BALE BAGGING APPARATUS

BACKGROUND OF THE INVENTION

1. Field of the Invention

The present invention relates to a bale bagging apparatus, and more particularly to such an apparatus for placing a bag over a previously strapped bale in which the bale is stationary while the bag is drawn over the bale.

2. Description of the Prior Art

It is well known to protect a previously formed and strapped cotton bale by covering the bale with a bag. The bag is necessarily substantially longer than the bale so as to cover the ends of the bale. Insofar as the applicant is aware, such bagging previously has been performed by moving the relatively heavy bale, having a weight of approximately 500 pounds (225 kilograms), into the bag which is held stationary. This process is cumbersome and wasteful of energy since the relatively heavy bale is moved rather than the lighter bag. Typically, after each bale is formed and strapped, it is transported to a storage area on a horizontal conveyor. Prior art apparatus for bagging a bale moves each bale in a direction normal to its path of movement along the conveyor and then returns the bale to this path to continue along the conveyor. The apparatus required to transport the bale along such a detour is expensive and bulky not only because of the weight of the bale, but because the detour must be at least as long as the length of the bag which is supported in a fully opened condition for insertion of the bale therein.

PRIOR ART STATEMENT

In conformance with 37 C.F.R. 1.97 and 1.98, the applicant states that he is not aware of any prior art which is relevant to the patentability of the subject invention.

SUMMARY OF THE INVENTION

It is an object of the present invention to provide an improved bale bagging apparatus.

Another object is to provide such an apparatus in which the bale is held stationary while the bag is drawn over the bale.

Another object is to provide such an apparatus wherein the bale is not detoured from a direct path of travel during bagging operations.

Another object is to provide such an apparatus which is compact and economical.

These and other objects and advantages are obtained by a bale bagging apparatus in which a bale moves in a predetermined path along a conveyor and is retained thereon while a sleeve having the bag telescoped over it moves normally of the path over the bale stripping the bag from the sleeve and into covering relation to the bale.

BRIEF DESCRIPTION OF THE DRAWINGS

FIG. 5 is a fragmentary vertical section taken from the position of line 5—5 of FIG. 2 but showing the movable elements at respective positions subsequent to their positions in FIG. 4.

FIG. 6 is an enlarged fragmentary section taken on line 6—6 of FIG. 5 with alternate positions shown in dash lines.

FIG. 7 is a fragmentary plan view taken from the position of line 7—7 of FIG. 6.

DESCRIPTION OF THE PREFERRED EMBODIMENT

Referring with greater particularity to the drawings, a bale bagging apparatus 20 embodying the principles of the present invention is shown in FIGS. 1 through 4. The apparatus is shown supported by a floor 25.

Figure 2:
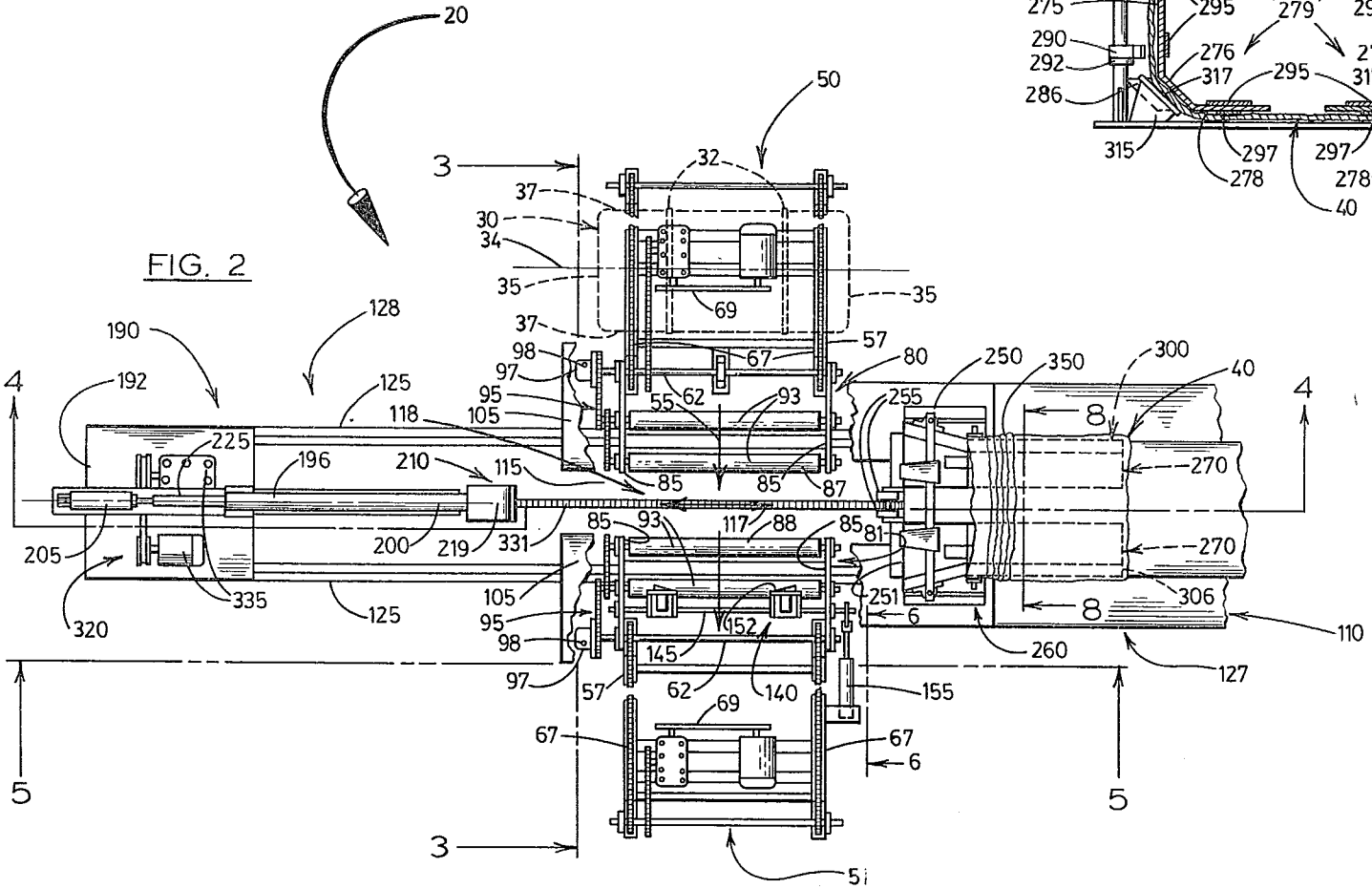
FIG. 2 is a plan view of the apparatus of FIG. 1 but with movable elements of the apparatus and a bale, which is depicted by dash lines, in positions preceding their respective positions depicted in FIG. 1.
Figure 3:
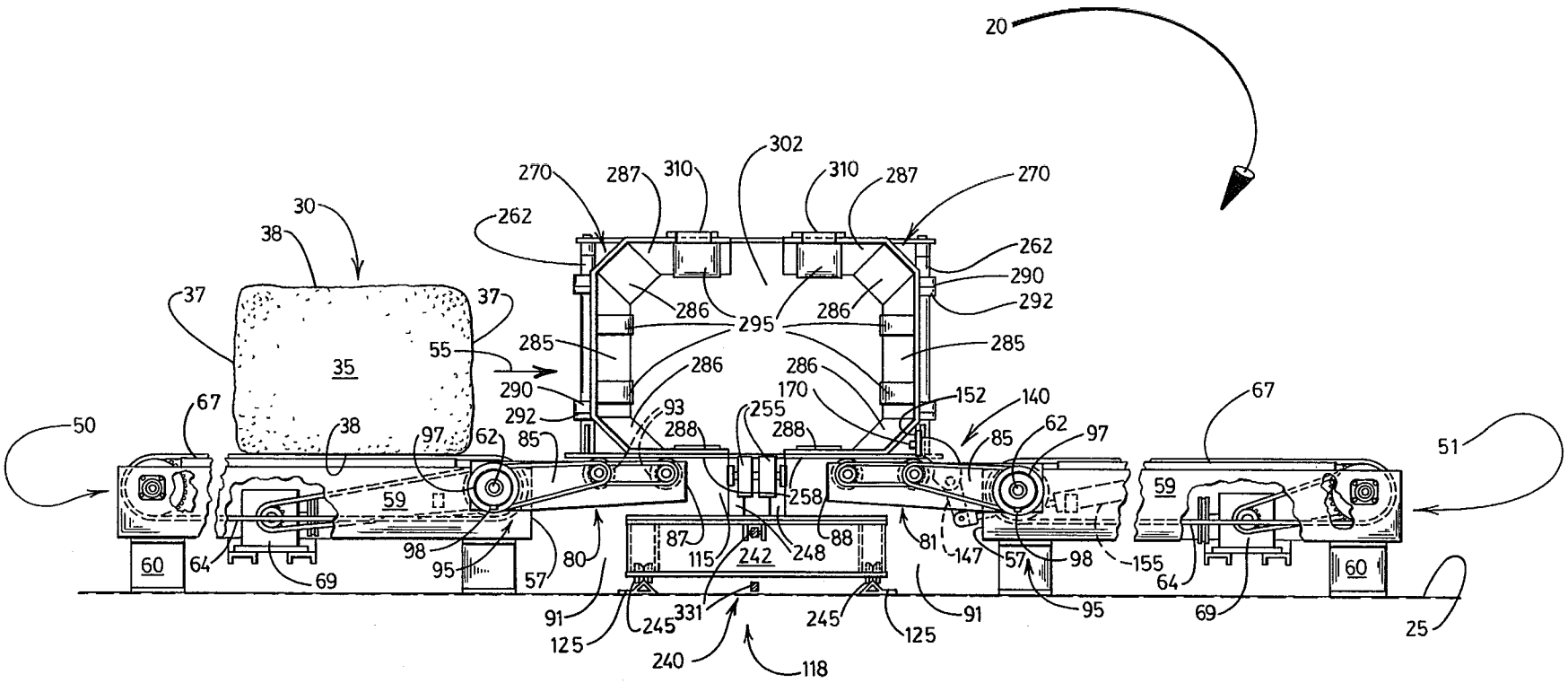
FIG. 3 is a vertical section of the apparatus of FIG. 1 at an enlarged scale taken from the position of line 3—3 in FIG. 2.

The apparatus 20 is adapted for operation with a bale 30 of cotton, or the like, best shown in FIGS. 2 and 3, which is held together by straps 32. The bale is of elongated prismatic form having a central longitudinal axis 34 and longitudinally opposite ends 35. The cross section of the bale is generally rectangular so that the bale has a pair of opposite shorter transverse sides 37 and a pair of opposite longer transverse sides 38.

Figure 1:
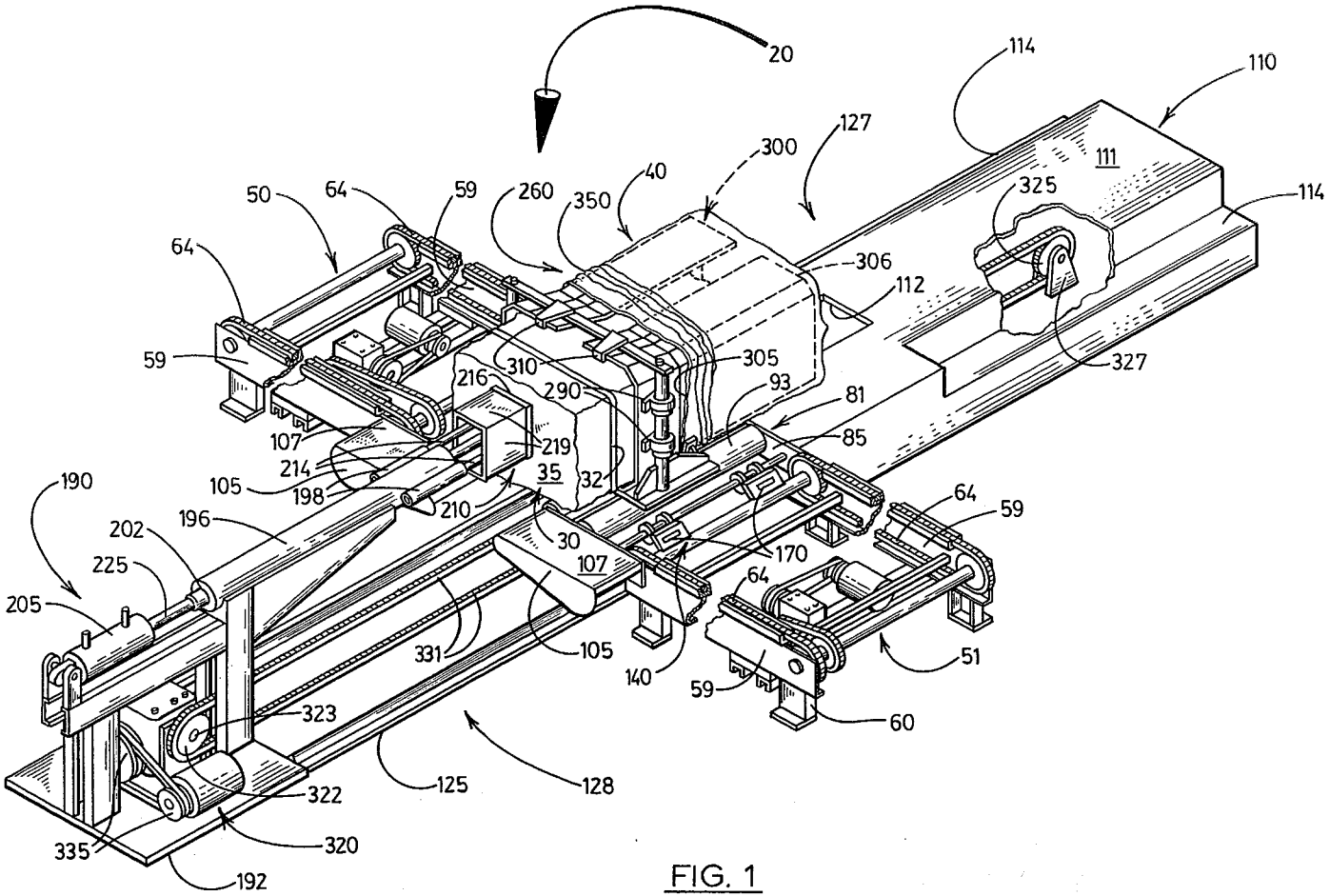
FIG. 1 is a perspective view of a bale bagging apparatus embodying the principles of the present invention together with a bale being covered with a bag. Portions of the bag and apparatus are depicted as broken away for illustrative convenience.
Figure 4:
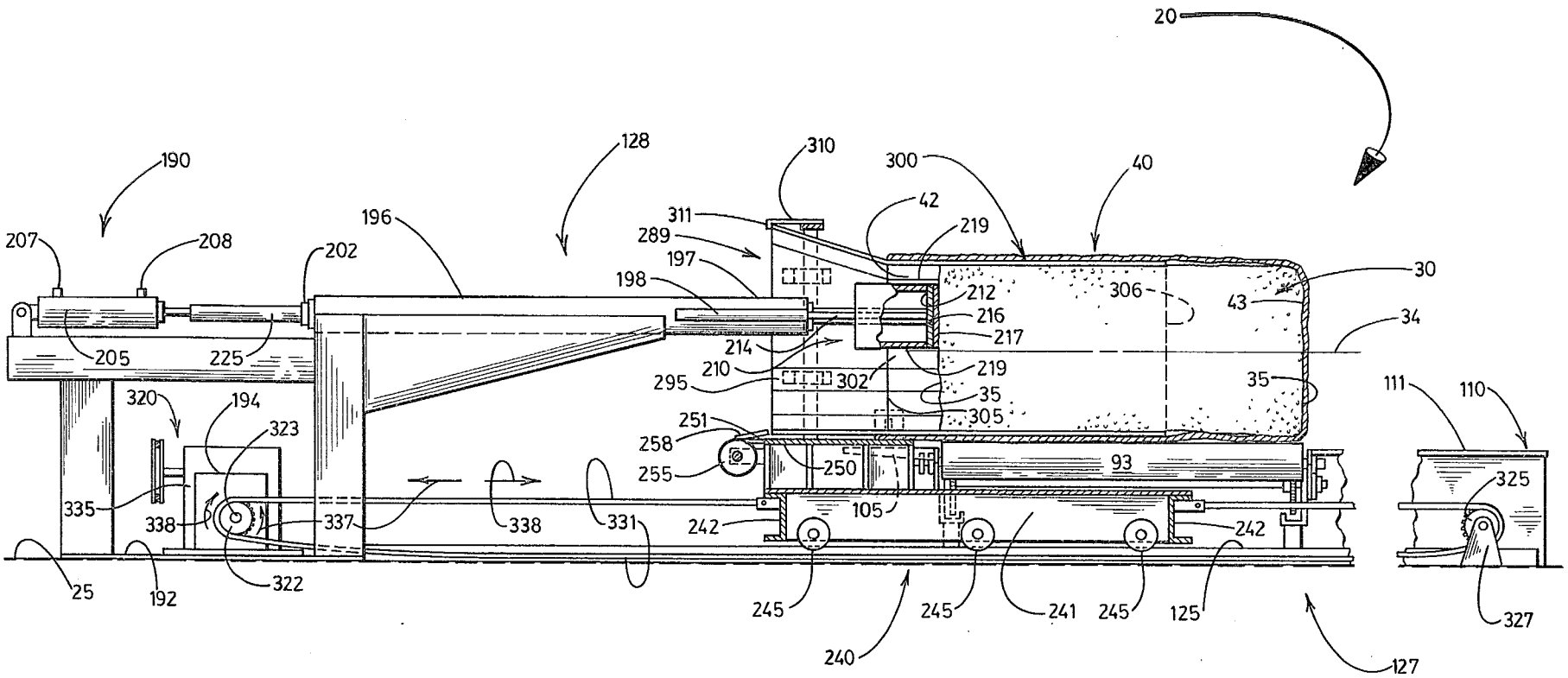
FIG. 4 is a vertical section taken from the position of line 4—4 of FIG. 2 but showing the movable elements and the bale in respective positions subsequent to those depicted in FIGS. 1 and 2.

Elongated bags 40, best shown in FIGS. 1, 2, and 4, each having an open longitudinal end 42 and an opposite closed longitudinal end 43 are placed on the bales 30 by the apparatus 20. The bag is substantially longer than the bale and is dimensioned and proportioned to enclose the bale 30, as will become apparent.

The apparatus 20 is associated with a bale supply conveyor 50 and a bale removal conveyor 51 shown in FIGS. 1, 2, 3, and 5. These conveyors are fragmentarily represented and are of well-known, elongated construction for conveying a bale 30 horizontally and longitudinally therealong. The conveyors are aligned longitudinally in end-to-end relation to define a first substantially linear path indicated by the arrows 55 in FIGS. 2 and 3 along which the bale moves in a direction from the supply conveyor toward the removal conveyor. These conveyors have facing individual end portions 57 disposed along the path a distance somewhat greater than the length of a side 38 of the bale. Each conveyor has a pair of opposite, longitudinally extending, parallel side rails 59 spaced a distance somewhat less than the length of a bale. These conveyors are supported on and upwardly of the floor 25 by feet 60 extended downwardly from the side rails. Each of the end portions of the conveyor has a transverse shaft 62 rotationally mounted on the corresponding side rails and provided with a pair of sprockets individually adjacent to the rails. The pair of sprockets adjacent to each rail is looped by an endless chain 64 which extends along the corresponding rail. Each chain has an upper run 67 which is supported by this rail. Each conveyor has an electrical rotational drive unit 69 which continually drives one of its shafts so that its upper run moves in a direction along the first path.

When the apparatus 20 is in operation, a bale 30 to be covered with a bag 40 is disposed upwardly on the feed conveyor 50 rested on the upper runs 67 of the chains 64. The bale is disposed with its longitudinal axis 34 extending horizontally and normally to the first path 55. When so disposed, one of the longer sides 38 of the bale is rested on the upper runs and one of the shorter sides 37 of the bale is disposed in the direction of movement along the path so that the bale is transported along the path in a direction transversely of its length.

The apparatus 20 has a feed conveyor 80 which extends along the first path 55 from the end portion 57 of the supply conveyor 50. The feed conveyor is mounted on this end portion and extends from it less than one-half of the distance from it to the corresponding end portion of the removal conveyor. The apparatus has a discharge conveyor 81 which is, in general, a "mirror image" of the feed conveyor and is mounted on and extends from the end portion of the removal conveyor 81 toward the supply conveyor. The feed and discharge conveyors each have a pair of side rails 85 which extend individually from and are substantially aligned longitudinally with the corresponding one of the side rails 59. These four conveyors are, therefore, substantially equal in width. The feed conveyor has a discharge end 87 disposed toward the discharge conveyor and the discharge conveyor has a receiving end 88 disposed toward the feed conveyor. The supply and discharge conveyors are thus disposed in end-to-end relation along the first path. Since the length of the supply and discharge conveyors is less than the distance between the end portions 57, the discharge end and the receiving end are spaced apart along the path. The distance between these ends is substantially less than the length of the longer sides 38 of a bale 30 so that a bale being transported by the supply conveyor bridges these ends for transport by the feed and the discharge conveyors along the path from the supply conveyor to the removal conveyor. The transversely corresponding side rails 85 of the feed and discharge conveyors are cantilevered toward each other from their corresponding end portions 57 so that there is an unobstructed space 91 between each rail and the floor 25.

The feed conveyor 80 and the discharge conveyor 81 are each provided with a pair of substantially identical transverse rollers 93 extended between the corresponding side rails and rotationally supported thereon. Each pair of rollers is disposed along the first path 55 toward the end 87 or 88 of the corresponding conveyor. The rollers of each pair are spaced apart somewhat along this path with the tops of all of the rollers substantially at the elevation of the upper runs 76. Each pair of rollers is provided with a rotational drive assembly 95 of conventional construction for rotationally driving each roller from the adjacent one of the shafts 62 so that the rollers urge a bale 30 rested on them along the first path. The assembly is disposed outwardly of the one of the side rails 85 which is depicted as toward the left of FIG. 2. The drive assembly includes a pneumatic clutch 97 having a pneumatic connection 98. The clutch connects the shaft in driving relation to the rollers when pneumatic pressure is applied to the connection and disconnects the shaft when pneumatic pressure is removed from the connection.

Each of the conveyors 80 and 81 has a shield 105, best shown in FIGS. 1, 2, and 5, extending over its drive assembly 95 from the corresponding side rail 85. Each shield has a horizontal planar upper surface 107 which is substantially at the same elevation as the upper runs 67 and the tops of the rollers 93. These surfaces are coextensive with the side rails in a direction along the first path 55.

The apparatus 20 has a box-like table 110 mounted on the floor 25 at the side of the conveyors 80 and 81 opposite to the shields 105. The table has a horizontal plate 111 which is substantially in the plane of the surfaces 107 and has a central rectangular notch 112 which opens toward the conveyors. The width of this plate along the first path 55 is substantially equal to the distance between the respective ends 57 of the conveyors 50 and 51. The width of the notch is substantially equal to the distance between the ends 87 and 88, respectively, of the conveyors 80 and 81. The portions of the plate alongside the notch are thus substantially coextensive in a direction along the first path with the corresponding side rails 85 and the shields. The table is juxtapositioned to the transversely corresponding pair of the side rails and the notch extends in a direction away from these rails a distance substantially greater than the length of a bag 40. The table extends in this direction substantially beyond the notch. The portion of the table beyond the notch is provided with a pair of steps 114 extended in this direction substantially beyond the notch and disposed oppositely of it.

Since, as previously described, the respective ends 87 and 88 of the feed conveyor 80 and the discharge conveyor 81 are spaced apart along the first path 55 and since the surfaces 107 and the portions of the plate 111 outward of the notch 112 are coextensive with the conveyors, these elements define a gap 115, best shown in FIG. 2, extending normally to and transversely across the first path 55 between the conveyors. This gap includes the notch 112 and extends between the shields 105. This gap lies along a second linear horizontal path of travel, indicated by the arrows 117 in FIG. 2, which extends normally and transversely across the first path. The second path crosses the first path between the feed and discharge conveyors defining a bagging station 118 to which the bale is transported by these conveyors upon delivery to them by the supply conveyor 50. The ends 87 and 88 of the conveyors are symmetrically disposed with respect to the center of the second path.

A pair of tracks 125, best shown in FIGS. 1 through 4, are mounted directly on the floor 25 in parallel spaced relation and extend along the second path 117 individually beneath the conveyors 80 and 81. Each track has an inverted V-shaped cross section as best shown in FIG. 3. The tracks extend oppositely of the conveyors a distance greater than the length of a bag 40. The portion of these tracks beyond the shields 105 at one side of the conveyors defines a receiving position 127 along the second path. The opposite portion of the tracks beyond the the shields 105 at the other side of the conveyors defines a stripped position 128 along this path. These positions are thus disposed oppositely along this path from the bagging station 118.

The apparatus 20 has a barrier 140, best shown in FIGS. 1, 2, 5, 6, and 7, disposed at the bagging station 118. The barrier is pivotally mounted on the side rails 85 of the discharge conveyor 81 for movements, as shown in FIG. 6, between a blocking position 142 shown in solid lines and a retracted position 143 shown in dash lines. The barrier has a horizontal shaft 145 which is parallel to the second path 117. This shaft extends through each of these side rails at a point which is between the corresponding rollers 93 and the receiving end 88 of the removal conveyor 51 and is below the top of these rollers. The shaft is pivotally received in the rails at these points. A lever 147 is fixedly mounted on the shaft outwardly of the one of the rails which is disposed toward the receiving position.

The barrier 140 has a pair of plates 150 fixedly mounted on its shaft 145 between the side rails 85 by suitable brackets. The plates are spaced along the shaft so as to be individually adjacent to the side rails. Each plate has a planar face 152, which, when the barrier is in the blocking position 142, is disposed vertically and upwardly of the rails across the first path 55 and parallel to the second path 117. Each of the plates is provided with a slot 154 opening through its face. The faces lie in a common plane and, in effect, form a single face which is similarly related to these paths. The barrier is dimensioned and proportioned so that when it is in the blocking position, each face is spaced along the first path from the center of the gap 115 a distance substantially equal to one-half of the length of a side 38 of a bale 30. In its retracted position, the barrier is pivoted from its blocking position in a direction in which the plates move away from the gap. In the retracted position, the faces are substantially horizontal and are disposed below the tops of the rollers 93.

The apparatus 20 has a pneumatic ram 155 of well-known construction which interconnects the lever 147 of the barrier 140 and the adjacent one of the side rails 85. The ram is extended and contracted, respectively, by the application of pneumatic pressure to pneumatic connections 157 and 158 by means not shown. The dimensions of the ram and the lever and their disposition relative to the shaft 145 are such that extension of the ram pivots the barrier to its retracted position 143 and contraction of the ram pivots the barrier to its blocking position 142.

The apparatus 20 has a control system which includes a pair of levers or projections 170, best shown in FIGS. 2, 6, and 7, individually mounted on the plates 150 for movement with the barrier between its blocking position 142 and its retracted position 143. One end of each lever is pivotally mounted on the corresponding plate oppositely of its face 152. The other end of the lever extends through the corresponding slot 154. The lever is urged by a spring 173 into a position 175 in which the lever is extended toward the gap 115 when the barrier 140 is in its blocking position. Pressure against the lever toward the plate urges the lever into a position 176, depicted in dash lines in FIG. 7, in which it is flush with the face. The control system includes a pair of electrical switches 178 of well-known construction individually mounted on the plates rearwardly of their faces for actuation by the corresponding lever as the lever moves between its extended and its flush positions. The control system is adapted to remove pneumatic pressure from the connections 98 of the clutches 97 when both of the levers are in the flush position so that the conveyors 80 and 81 stop when both levers are disposed in this position. When the levers are not so disposed, the system provides for selective removal of pneumatic pressure from these connections. These conveyors may, therefore, be selectively stopped although either or both of the levers are in the extended position.

The apparatus 20 includes a stop assembly 190 shown in FIGS. 1, 2, 4, and 5. The assembly is disposed at the bagging station 118 along the second path 117 at the side of the conveyors 80 and 81 which is disposed toward the stripped position 128. The assembly has a base 192 of unitary construction mounted on the floor 25 beyond the stripped position and beyond the tracks 125. The base has a floor plate flatly disposed against the floor and a pair of columns extended upwardly from this plate and spaced in a direction along the second path. The base has a vertical mounting plate 194 extending parallel to this path immediately above the floor plate and between the columns. This plate is spaced somewhat toward the discharge conveyor 81 from the center of the gap 115. The upper ends of the columns are connected by a horizontal rail from which a first cylindrical tube 196 extends parallel to the second path across the stripped position to an end portion 197. A pair of vertical gusset plates extend downwardly from this tube interconnecting it with the adjacent one of the columns. This end portion is spaced a distance of approximately one foot (30 cm) from the pair of side rails 85 which are disposed toward the stripped position. A pair of cylindrical second tubes 198 are fixedly mounted on this end portion horizontally oppositely of it. The second tubes are parallel to the first tube but are substantially shorter and smaller in diameter.

The first tube 196 defines a horizontal axis 200, shown in FIGS. 2 and 5, which extends along the second path 117 in a vertical plane extended centrally through the gap 115. This axis is disposed above the tops of the rollers 93 a distance somewhat more than one-half of the length of a side 37 of a bale 30. The end of the first tube opposite its end portion 197 has a cylindrical guide 202 aligned with this axis.

The stop assembly 190 includes a pneumatic ram 205 of well-known construction mounted by a clevis on the base 192. The ram is substantially aligned with the axis 200. The ram is extended by application of pneumatic pressure to a connection 207 thereof and contracted by application of such pressure to a connection 208 thereof by means not shown.

The assembly 190 includes a stop 210 mounted on the end portion 197 of the tube 196 for reciprocal movement along the axis 200. The stop is thus disposed along the second path 117 adjacent to the side of the conveyors 80 and 81 which is disposed toward the stripped position 128. The stop has a substantially square plate 212 disposed normally to the axis and centered thereabout. The plate is substantially smaller than a longitudinal end 35 of the bale 30. A pair of cylindrical guides 214 extend from the plate toward the ram 205. The guides are individually slidably received in the tubes 198 so that the stop moves in a direction along the second path. This plate is covered with a layer 216 of anti-friction material defining a face 217 of the stop disposed toward the bagging station 118. This layer preferably is constructed of the synthetic resin sold under the trademark "Teflon." The stop is provided with four rectangular side plates 219 individually extended from the edges of the plate parallel to the axis 200 to form a box extended from the face toward the ram.

The stop 210 includes a cylindrical rod 225 extending along the axis 200 and rigidly interconnecting the plate 212 and the ram 205 so that the stop is reciprocated by extension and contraction of the ram. The rod thus extends from the face 217 in a direction away from the conveyors 80 and 81 to an end of the rod connected to the ram and disposed beyond the stripped position 128 from the second path 117. The length of the rod is such that, when the ram is contracted, the stop is disposed in a releasing position 227 shown in solid lines in FIG. 5 in which the plate is axially adjacent to the end portion 197 of the tube 196. When the ram is extended, the stop is moved along the second path 117 to a retaining position 228, shown in dash lines in FIG. 5, in which the face is above the pair of side rails 85 which are disposed toward the stripped position. When in its retaining position, the stop is thus adjacent to the first path 55 at the side thereof toward the stripped position.

As best shown in FIGS. 3, through 5, the apparatus 20 includes a carriage 240 mounted on the track 125 and guided thereby for reciprocal movement along the second path 117 across the bagging station 118 and the first path 55. The carriage reciprocates between a first position in which it is disposed in the receiving position 127 at one side of the conveyors 80 and 81 and a second position at the other side of the conveyors in which the carriage is disposed in the stripped position 128.

The carriage 240 has an elongated horizontal rectangular frame 241 disposed in upwardly adjacent relation to the floor 25 between the tracks 125 and aligned longitudinally therewith. The frame has a pair of longitudinally opposite ends 242 spaced along the second path 117. The longitudinally extending sides of the frame are approximately equal in length to the length of a bale 30. Each of these sides is provided with three grooved wheels 245 spaced along it. These wheels rollingly engage the corresponding track so as to support the carriage and guide it to move along the second path. The frame is upwardly covered by a lower horizontal plate fixed thereto and disposed at an elevation which is below the conveyors 80 and 81. This plate and the frame thus pass through the spaces 91 as the carriage moves between the receiving position 127 and the stripped position 128. The carriage has a pair of pillars 248 which are fixed to this plate and extend upwardly from it to an elevation somewhat above the tops of the rollers 93. The pillars are disposed at the end of the frame which is toward the stripped position 128 and are spaced along the second path a distance approximately one-third of the length of the longitudinal sides of the frame. The overall dimensions of the pillars in a direction parallel to the first path 55 are somewhat less than the width of the gap 115. The pillars pass thus through the notch 112 and between the respective facing ends 87 and 88 of the conveyors 80 and 81 as the carriage moves between the receiving position and the stripped position.

The carriage 240 has an upper rectangular horizontal plate 250 fixedly mounted on the upper ends of the pillars 248. The plate has a leading edge 251 which is parallel to the second path 117 and is disposed toward it when the carriage is in the receiving position 127. The width of the plate along the first path 55 is substantially greater than the length of the side 38 of a bale 30 so that the plate extends along the second path in covering relation to the pillars. The elevation of this plate is such that it is above, but closely adjacent to, the tops of the rollers 93 as the carriage moves across the bagging station 118.

The carriage 240 has a pair of rollers 225 disposed outwardly of the upper plate 250 and adjacent to its leading edge 251. The rollers are mounted outwardly of this plate for rotation about a horizontal axis parallel to the first path 55 on a bracket extended from the adjacent one of the pillars 248. The rollers have a cylindrical circumference, the top of which is disposed substantially at the elevation of the upper surface of the upper plate. The rollers are aligned with the pillars in a direction along the second path so that the rollers pass through the gap 115 with the pillars. The rollers are flanked in a direction along the first path by a pair of ramps 258 which extend in opposite directions therealong from the rollers. The overall length of the ramps along the first path is approximately equal to the length of a side 38 of a bale 30. The ramps extend downwardly from the leading edge of the upper plate in a direction along the second path to a point somewhat below the top of the rollers and approximately vertically above their axis.

The apparatus 20 has a bag receiving assembly 260, shown in FIGS. 1 through 5 and 8, mounted upwardly on the carriage 240 for movement therewith along the second path 117 between the receiving position 127 and the stripped position 128. This assembly has a pair of cylindrical rods 262 fixedly mounted on the plate 250 and extended upwardly from it about individual erect axes. The rods are disposed toward the corners of the plate at the opposite end thereof from the leading edge 251. The rods have a height substantially greater than the length of the shorter side 37 of a bale and are spaced along the first path 55 a distance substantially greater than the length of the longer side 38 of a bale. These rods are symmetrically disposed in relation to the second path so that the axis 200 extends centrally between them substantially at the elevation of the center of a bale 30 being transported by the conveyors 80 and 81. The assembly includes a gusset plate extending parallel to the second path in opposite directions from the lower end of each rod to brace the rod. The assembly includes a strap 264 rigidly and detachably interconnecting the upper ends of the rods for additional bracing.

Figure 8:
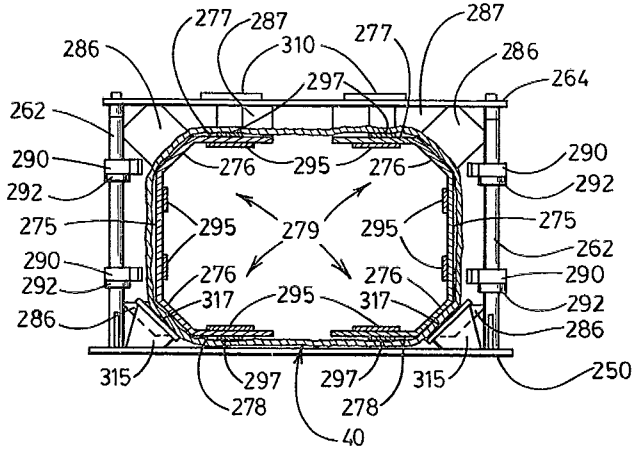
FIG. 8 is an enlarged fragmentary vertical section taken on line 8—8 of FIG. 2.

The receiving assembly 260 includes a pair of baggers 270 disposed between the rods 262 and individually mounted thereon for movement with the carriage 240 along the second path 117. The baggers are "mirror images" of each other and are disposed in facing relation substantially symmetrically about a vertical plane containing the axis 200 and extending through the gap 115. As best shown in FIG. 8, each bagger is of generally U-shaped construction, opening toward the other bagger and conforming to the half of a bale 30 disposed toward one of its sides 27. Each bagger has a tail section 272 formed by rectangular plates 275, 276, 277, and 278, which are substantially parallel to the axis 200. The length of these plates parallel to this axis is substantially less than the length of a bale. The plate 275 is vertical and forms the central section of the "U". A pair of corner plates 276 extend diagonally from the opposite edges of this central section to respective horizontal plates, an upper plate 277 and a lower plate 278. Each horizontal plate with the adjacent corner plate defines a leg 279 of the "U". Each bagger thus has a pair of legs which are vertically spaced and extend individually toward the vertically corresponding leg of the other bagger. The ends of the legs lie in a common vertical plane parallel to the corresponding central plate.

Each bagger 270 has a head section 280 formed by planar guide members 285, 286, 287, and 288 which extend, respectively, from the plates 275, 276, 277, and 278, toward the bagging station 118 when the carriage 240 is in the receiving position 127. The guide members terminate in a common plane normal to the vertical central plate 275. The guide member 288 is horizontal and lies in the same plane as the lower plate 278. However, the other guide members diverge obliquely outwardly from the axis 200 so that the baggers form a funnel 289 opening toward the bagging station, as best shown in FIGS. 3 and 4. The length of the guide members parallel to this axis is such that the overall length of each bagger is approximately equal to that of a bale 30. The outward side of the guide member 285 extended from the central plate 275 is flatly engaged by a reinforcing plate. The plates and guide members of each bagger are connected, as by welding, so that it is of unitary construction.

Each bagger 270 is disposed with its guide member 285 adjacent to the corresponding one of the rods 262. The rods are thus disposed outwardly and oppositely of the tail sections 272 of the baggers. As best shown in FIGS. 1, 2, 5, and 7, the bagger is connected to this one rod by a pair of vertically spaced pillow blocks 290 which are fixedly connected to the guide member and are fitted to the rod for pivotal movement about its erect axis. The dimensions of the blocks are such that, when the vertical central plates 275 are parallel to each other and to the axis 200, the ends of the legs 279 are spaced somewhat apart in a direction along the first path 55. A pair of set collars 292 are fixedly mounted about each rod individually beneath the corresponding pillow blocks. The collars are disposed so that the blocks are rested thereon when the lower plate 278 and guide member 288 of the corresponding bagger are lightly engaged with the upper plate 250 of the carriage 240. When so engaged, the end of this guide member opposite the lower plate is juxtapositioned to the corresponding one of the ramps 258. The baggers thus extend from the ramps approximately to the one of the ends 242 of the frame 241 which is disposed toward the bagging station when the carriage is in the receiving position 127.

Each bagger 270 has four strips 295 of anti-friction material applied directly to the interior thereof and extended in a direction parallel to the axis 200 and the second path 117. Each strip extends in this direction entirely through the interior of the bagger. One strip extends beneath the upper plate 277 and the corresponding guide member 287. Another strip extends above the lower plate 278 and the corresponding guide member 288. The other pair of strips extend individually along the upper and lower edges of the central plate 275 and the guide member 285. The strips, preferably, are formed of the synthetic resin polymer referred to above. Each bagger is provided with a pair of strips 297 of friction material applied directly to the exterior thereof and extended therealong parallel to the axis 200. One of these strips is disposed centrally of the upper plate and the corresponding guide member. The other strip of friction material is similarly disposed on the lower plate and guide member. These strips, preferably, are formed of a material known as "PVC Rough Top Belting."

When the baggers 270 are mounted on the carriage 240 in the manner described, their tail sections 272 define an elongated tubular sleeve 300 having an opening 302 therethrough which conforms to the cross section of a bale 30 normal to its axis 34. This sleeve is disposed so that the axis 200 along the second path 117 extends through the sleeve somewhat above its central longitudinal axis as best shown in FIG. 5. The tail sections thus are first and second portions of the sleeve which are disposed oppositely of each other from this axis.

The sleeve 300 has a first open longitudinal end 305 disposed at the plane where the tail sections 272 and the head sections 280 are joined. The sleeve has a second open longitudinal end 306 disposed oppositely of the head sections. The first end is thus disposed toward the bagging station 118 when the carriage is in the receiving position 127 and the sleeve is, therefore, in a first position corresponding to the receiving position. The second end of the sleeve is disposed toward the bagging station when the carriage is in the stripped position 128, the sleeve then being in a second position corresponding to the stripped position. Since, as previously described, the baggers 270 conform to the shape of the bale, the sleeve is adapted to telescope in circumscribing relation over a bale 30 disposed with its axis 34 aligned with the axis 200. Since a bag 40 is adapted to enclose a bale and the sleeve conforms to a bale, the sleeve is further adapted to receive a bag over it externally in telescoped relation. Since the stop 210, as viewed along the axis 200, is substantially smaller than an end 35 of a bale and the sleeve conforms exteriorly to a bale, the stop is adapted to pass centrally through the sleeve without contacting it.

The assembly 260 has a pair of catches 310 individual to the baggers 270 which limit pivotal movement of the baggers about the corresponding rods 262. The catches are mounted on the strap 264 and extend from it in a direction opposite of the tail sections 272. Each catch extends to a point above the end of the corresponding upper guide member 287. The catch has a lip juxtapositioned to this end and provided with a planar surface 311 normal to the axis 200. This surface is positioned so as to be engaged by this end when the corresponding bagger is pivoted to a position where its central plate 275 is substantially parallel to the axis 200. The pivotal movement of the baggers about their respective rods is thus limited so that their tail sections are disposed in parallel or somewhat divergent relation along the second path 117.

The bag receiving assembly 260 includes a pair of bag retainers 315, best shown in FIGS. 1, 5, and 8, fixedly mounted on the upper plate 250 in outwardly adjacent relation to the lower pair of corner plates 276 of the sleeve 300. These retainers are disposed at the edge of the upper plate opposite its leading edge 251. Each retainer has an inclined plate providing a planar face 317 disposed toward the corresponding corner plate. The face is spaced somewhat from the corner plate and is substantially parallel to it.

The apparatus 20 has a power reciprocating drive assembly indicated generally by the numeral 320 and best shown in FIGS. 1, 2, and 4. This unit is adapted to power a stroke of the carriage 240 along the tracks 125 and the second path 117 from the receiving position 127 to the stripped position 128 and to power a return stroke of the carriage from the stripped position to the receiving position. This assembly has a drive sprocket 322 disposed beneath the axis 200 and mounted on a shaft 323. The shaft is in turn mounted on the plate 194 for rotation about a horizontal axis normal to the second path 117. This sprocket is, therefore, disposed outwardly of the stripped position 128 from the bagging station 118. This assembly has an idler sprocket 325 disposed outwardly of the receiving position 127 from the bagging station beneath the plate 111 of the table 110 and mounted on a bracket 327 fixed on the floor 25. The idler sprocket is aligned vertically and horizontally with the drive sprocket and rotates about an axis parallel to that of the drive sprocket. These sprockets are looped by a chain 331 having opposite ends individually interconnected to the ends 242 of the frame 241. These ends of the chain are disposed in an upper run thereof which passes over the upper side of the sprockets and is interrupted by the frame. The chain has an uninterrupted lower run interconnecting the lower sides of the sprockets.

The assembly 320 includes a reversible electric rotational drive unit 335 of well-known construction connected in driving relation to the drive sprocket 322 and disposed oppositely of the mounting plate 194 from it. The drive unit is selectively energizable to rotate the sprocket so as to drive the upper reach of the chain and the carriage in a direction from the receiving position toward the stripped position, as shown by the arrows 337 in FIG. 4, or to rotate the sprocket oppositely to drive the carriage from the stripped position toward the receiving position as indicated by the arrows 338. This unit is selectively de-energizable when the carriage is in either of these positions so that the carriage remains therein until the drive unit is energized.

OPERATION

The operation of the described embodiment of the present invention is believed to be clearly apparent and will be briefly summarized at this point.

When the apparatus 20 is in operation and in a disposition to bag a bale 30, the carriage 240 and sleeve 300 are in the receiving position 127 with the drive unit 320 deenergized; the ram 205 is contracted so that the stop 210 is in its releasing position 227; and pneumatic pressure is applied to the retracting connection 158 of the ram 155 so that the barrier 140 is pivoted into its blocking position 142. Since neither of the levers 170 is in its flush position 176, the conveyors 80 and 81 are driven, as previously described, by their respective drive mechanisms 95 from the corresponding one of the shafts 62 of the continuously driven supply conveyor 50 and removal conveyor 51.

With the apparatus 20 so disposed, the open end 42 of a bag 40 is then fitted externally over the second end 306 of the sleeve 300 and the bag is drawn in circumscribing relation over the sleeve in a direction from its second end toward its first end 305. The open end of the bag is drawn over the sleeve until it is adjacent to the first end of the sleeve and the guide members 285, 286, 287, and 288 and is frictionally engaged between the lower pair of the corner plates 276 and the faces 317 of the retainers 315. The bag is drawn over the sleeve until its closed end 43 engages the second end of the sleeve. Since, as previously described, the bag is longer than a bale and the sleeve is shorter than a bale, the bag is then disposed in a pleated disposition over the sleeve as indicated in FIG. 1 by the numeral 350. When the bag is so received on the sleeve, the open end of the bag is disposed toward the conveyors 80 and 81 and toward the bagging station 118. The interior of the bag is engaged by the strips 297 of friction material when the bag is drawn over the sleeve.

A bale 30 is then placed on the supply conveyor 50 with one of the sides 38 rested on the chains 64 of the conveyor. The bale is disposed with its ends 35 projecting approximately equally beyond the chains. One of the shorter sides 37 of the bale is then disposed toward the barrier 140. The relative disposition of the bale and the apparatus 20 at this point is shown in FIGS. 2 and 3. Since the supply conveyor runs continuously, it transports the bale toward the bagging station 118. At this station, the bale is received in succession by the feed conveyor 80 and the discharge conveyor 81 so that their respective rollers 93 urge the bale along the first path 55 until the bale moves from the supply conveyor and its side disposed toward the barrier becomes engaged with the faces 152 thereof. If, as is usually the case, the axes 34 and 200 are not substantially parallel, the portion of this side toward one end portion of the bale engages the face of the corresponding one of the plates 150, arresting movement of this portion of the bale. Continued rotation of the rollers urges the bale to pivot about this portion until the bale engages the face of the other plate and is substantially aligned longitudinally with the sleeve 300. When the bale is so disposed, the first end 305 of the sleeve is disposed toward the one of the ends 35 of the bale and this end of the bale is in spaced juxtaposition to the first end of the sleeve. The barrier then blocks further movement of the bale along the first path.

When the bale 30 is disposed at the bagging station 118 in alignment with the sleeve 300 due to the engagement with the faces 152, the levers 170 are pressed into their flush positions 176 against respective springs 173 by the side 37 of the bale which is engaged with the faces 152. In their flush positions, the levers individually actuate the switches 178 to sense that both levers are in their flush positions. When this occurs, the clutches 97 are disengaged by removal of pneumatic pressure from their connections 98 so that the rollers 93 are no longer driven.

When the bale 30 is so disposed at the bagging station 118 with the axes 34 and 200 substantially aligned and the rotation of the rollers 93 of the conveyors 80 and 81 stopped, the application of pneumatic pressure to the clutches 97 is selectively prevented as previously described. Pneumatic pressure is then applied to the extending connection 157 of the ram 155 so that the ram extends and pivots the barrier 140 into its retracted position 143. The levers 170 are urged into their extended positions 175 by the springs 173 as the barrier retracts. However, since the application of pneumatic pressure to the clutches is now prevented, the rollers are not driven and the bale remains at the bagging station in alignement with the sleeve 300.

With the bale 30 disposed at the bagging station 118 with the axes 34 and 200 aligned, pneumatic pressure is applied to the extending connection 207 of the ram 205. As the ram extends, it urges the rod 225 and the stop 210 to move along the second path 117 toward the bale. This movement continues until the stop reaches its retaining position 228 wherein the face 217 engages the corresponding end 35 of the bale. This end is opposite the end of the bale disposed toward the sleeve 300. The stop is thus disposed to retain the bale on the conveyors 80 and 81 against a force urging the bale along the second path 117 in a direction from the receiving position 127 toward the stripped position 128.

With the bale 30 thus retained at the bagging station 118 and the conveyors 80 and 81 stopped, the drive unit 335 is energized so as to rotate the sprocket 322 and move the chain 331 in the directions indicated by the arrows 337. This movement of the chain draws the carriage 240 along the tracks 125 and the second path 117 from the receiving position 127 into the stripped position 128. As the carriage moves initially toward the stripped position, the sleeve 300 and the bag 40 received thereon are carried with the carriage toward the bale. As this movement continues, the rollers 255 and ramps 258 engage the downwardly disposed one of the sides 38 of the bale raising the bale so that the lower guide members 288 pass beneath it.

As the end 305 of the sleeve 300 approaches the bale 30 from the receiving position 127, the obliquely extended guide members 285, 286, and 287 engage the bale so that further movement of the sleeve urges the baggers 270 individually to pivot and/or translate vertically about their respective rods 262 so that the sleeve and bag are guided into alignment axially with the bale as the sleeve continues toward the stripped position 128. When so aligned, continued movement of the carriage 240 carries the sleeve and bag 40 in telescoping relation over the bale. Movement of the guide members and the baggers over the bale is facilitated by the strips 295 of anti-friction material which reduce frictional resistance to movement due to engagement between the bale and the sleeve. It should be noted that engagement of the sleeve with the guide members, the rollers 250, and the ramps 258 prior to final alignment of the axes 34 and 200 urges the bale to move somewhat transversely in relation to the face 217 of the stop 210. Frictional resistance due to the resulting movement between this face and the end 35 of the bale engaged therewith is minimized by the layer 210 of anti-friction material so as to further facilitate alignment of the sleeve and the bale along the second path 117.

As the carriage 240 continues to move toward the stripped position 128, the sleeve 300 and bag 40 telescope over the bale 30 as shown in FIG. 1. This telescoping action continues until the closed end 43 of the bag engages the bale. Since the bale is retained on the conveyors 80 and 81 by engagement with the stop 210, the closed end is prevented from moving further along the second path 117. Prior to this engagement, the strips 297 of friction material and the retainers 315 insured that the bag was retained on the sleeve. Now, however, continued movement of the carriage toward the stripped position results in the bag being stripped from the sleeve and drawn into covering or bagged relation with the bale as shown in FIG. 4. As the bag is drawn from the sleeve, the strips of friction material tend to retain the bag on the sleeve so that the bag is tensioned along the bale as the bag is drawn from the sleeve over the bale. Since the distance along the second path between the receiving position 127 and the stripped position is substantially greater than the length of the bag, the bag is drawn completely from the sleeve when the sleeve and carriage attain the stripped position.

During the described stroke of the carriage 240 and the sleeve 300 along the second path 117 from the receiving position 127 to the stripped position 128, the stop assembly 190 does not engage the carriage or the sleeve since the stop 210 and tubes 196 and 198 pass centrally through the sleeve without engaging it. When the carriage and the sleeve are disposed in the stripped position, the axes 200 remain substantially parallel and the second end 306 of the sleeve is disposed toward and in spaced juxtaposition to one of the ends 35 of the bale. This end of the bale is opposite the end thereof which is in spaced juxtaposition to the first end 305 of the sleeve before the stroke of the carriage into the stripped position from the receiving position.

When the carriage 240 has moved fully into the stripped position 128 from the receiving position 127 stripping the bag 40 onto the bale 30, the drive unit 335 is de-energized and pneumatic pressure is applied to the contracting connection 208 of the ram 205. The ram then contracts, drawing the rod 225 and the stop 210 from the bale so that the stop moves into its releasing position 227 and is disengaged from the bale with the face 217 spaced substantially from the bale. Although the stop 210 is now spaced from the bale, the open end 42 of the bag, which is longer than the bale, may drape over the stop. If this occurs, the side 219 of the stop prevent the plate 212 from hooking the bag as it and the bale are subsequently transported along the first path 55 from the bagging station 118. When the stop is in its releasing position, pneumatic pressure is selectively applied to the clutches 97 powering the rollers 93 so that the conveyors 80 and 81 transport the bagged bale over the barrier 140 which, as previously described, is in its retracted position 143. The bale is then transported from the bagging station 118 along the first path 55 onto the removal conveyor 51 which carries the bale from the apparatus 20, which is then disposed as shown in FIG. 5.

When the bale 30 and the bag 40 have been conveyed beyond the bagging station 118, the drive unit 335 is restarted so the sprocket 322 and chain 331 move as indicated by the arrows 338. The carriage 240 is thus driven in a stroke along the track 125 from the stripped position 128 into the receiving position 127. When the carriage reaches the receiving position, the drive unit is de-energized. At any time after the bale has passed over the barrier 140, pneumatic pressure is again applied to the retracting connection 158 of the ram 155 returning the barrier to its blocking position 142. When the barrier attains this position and the carriage is in the receiving position, the elements of the apparatus are disposed to receive another bag and bale and repeat the above described operation.

During this operation, it will be noted that the apparatus 20 covered the bale 30 with the bag 40 while the bale was stationary at the bagging station 118 and that the bale was not detoured from the first path 55 during its passage through the apparatus to receive the bag.

Although the invention has been herein shown and described in what is conceived to be the most practical and preferred embodiment, it is recognized that departures may be made therefrom within the scope of the invention, which is not to be limited to the illustrative details disclosed.

Having described my invention, what I claim as new and desire to secure by Letters Patent is:

1. A bale bagging apparatus for covering an elongated bale having a central longitudinal axis with a bag having an open end and an opposite closed end comprising:

A. a feed conveyor for transporting such a bale rested thereon along a first horizontal, generally linear path in a predetermined direction with the bale disposed with said axis extended generally horizontally and transversely of said direction of travel, said conveyor having a predetermined discharge end;

B. a discharge conveyor for transporting such a bale rested thereon along the path with the bale disposed with said axis extended generally horizontally and transversely of said direction of travel, the discharge conveyor having a receiving end disposed in spaced end-to-end relationship along the path with said discharge end, the distance between said ends being substantially less than the dimension of the bale along the path;

C. a track disposed downwardly of the conveyors and extended along a predetermined second horizontal, generally linear path substantially normal to the first path and disposed therealong so that said ends of the conveyors are disposed centrally in the second path;

D. a carriage mounted on the track for reciprocal movement along the second path from side to side of the conveyors and having an upwardly extended pillar disposed to pass between said ends of the conveyors during the reciprocal movement;

E. power means for simultaneously driving the conveyors to transport a bale so disposed thereon along the first path in a direction from the feed conveyor toward the discharge conveyor;

F. means powering a stroke of the carriage along the second path from a receiving position at one side of the conveyors to a stripped position at the opposite side of the conveyors;

G. a sleeve upwardly mounted on the pillars for movement with the carriage along the second path above the conveyors, the sleeve being elongated along a central axis thereof extended horizontally along the second path in a vertical plane extending between said ends of the conveyors, having a pair of open, longitudinally opposite ends, conforming centrally to the transverse cross section of the bale, and being adapted to receive such a bag in a disposition in which the bag is fitted outwardly of and along the sleeve with the open end thereof disposed toward the conveyors when the carriage is in the receiving position;

H. a stop disposed adjacent to said opposite side of the conveyors and dimensioned to pass centrally through the sleeve, the stop having a face normal to the central axis of the sleeve and a rod extended parallel to said axis from the face in a direction away from the conveyors to an end of the rod disposed beyond the stripped position;

I. means connected to the rod mounting the stop for reciprocal movement along the second path between a retaining position in which the face is adjacent to said opposite side of the conveyor and a releasing position in which the face is spaced substantially from the retaining position in a direction from the receiving position of the carriage toward the stripped position thereof;

J. control means for stopping the conveyors when the longitudinal axis of the bale is generally aligned in a direction along the second path with the central axis of the sleeve;

K. means for powering a stroke of the stop toward the retaining position thereof with said axes so aligned when the conveyors are stopped by the control means so that the face engages the bale retaining the bale on the conveyors against movement therefrom in a direction along the second path from the receiving position toward the stripped position;

L. means for powering a stroke of the carriage from the receiving position into the stripped position when a bag is so disposed on the sleeve and the face of the stop is so engaged with the bale, the sleeve passing over the bale so that the closed end of the bag engages the bale during said stroke and the bag is stripped from the sleeve into bagged relation with the bale as said stroke continues;

M. means for powering a stroke of the stop from the retaining position thereof into the releasing position thereof when said stroke of the carriage is substantially complete so that the face of the stop is spaced from the bale;

N. means for starting the conveyor driving means when said stroke of the stop into the released position thereof is substantially complete so that the bagged bale is transported along the first path in said predetermined direction from the second path; and O. means for powering a stroke of the carriage from the stripped position into the receiving position when the bagged bale has been so transported along the first path out of the second path.

2. The apparatus of claim 1 wherein the sleeve has a first portion and a second portion disposed oppositely of said central axis, each portion being U-shaped having a vertically extending central section and a pair of vertically spaced legs extended from the central section individually toward the vertically corresponding leg of the other portion, the portions defining an opening along said axis which substantially conforms to the transverse section of the bale.

3. The apparatus of claim 2 wherein each portion of the sleeve has a guide member mounted on the central section and a guide member mounted on the upper leg, said members extending obliquely outwardly from the central axis of the sleeve defining with the corresponding members of the other portion a funnel for guiding the sleeve over the bale as the carriage moves on said stroke from the receiving position into the stripped position.

4. The apparatus of claim 3 wherein the carriage includes:

A. a pair of vertical rods fixedly mounted on the pillar and spaced along the first path outwardly and oppositely of said portions of the sleeve, each rod being disposed adjacent to the guide member extended from the central section of the corresponding one of said portions; and B. means connecting each of said rods with said guide member adjacent thereto for vertical movement relative to the rod and for pivotal movement relative to the rod about an erect axis so that engagement of the bale with the guide members of the corresponding portion of the sleeve urges said portion vertically and pivotally on the rod into alignment with the bale during said stroke of the carriage from the receiving position into the stripped position.

5. The apparatus of claim 1 wherein the bale has a side disposed in the direction of movement along the first path and the apparatus further comprises a barrier mounted on the discharge conveyor for movement between a blocking position in which the barrier blocks movement of the bale along said path in said direction and a retracted position in which the barrier does not obstruct said movement, the barrier having a planar face disposed so that when the barrier is in the blocking position, the face extends substantially parallel to the second path and across the first path with the face spaced along the first path from the central axis of the sleeve a distance substantially equal to one-half of the width of the bale in a direction along the first path so that said side is urged against the face and into parallel alignment therewith by movement of the bale along the first path bringing the longitudinal axis of the bale into said alignment with the central axis of the sleeve.

6. The apparatus of claim 5 wherein the control system includes:

A. a pair of projections mounted on the barrier for movement therewith, each projection being mounted for individual movement relative to the face between a position in which the projection is substantially flush with the face and a position in which the projection is extended from the face toward the sleeve when the barrier is in the blocking position so that said side of the bale presses the projections individually into their flush positions when the barrier is in the blocking position and said axes are so aligned; and B. means for sensing that both projections are in their flush positions when pressed therein by said side of the bale.

7. The apparatus of claim 5 wherein the apparatus further comprises power means for moving the barrier into its retracted position from its blocking position when the conveyor is stopped by the control system and for moving the barrier to its blocking position from its retracted position when the bale is being transported along the first path toward the barrier.

8. The apparatus of claim 1 wherein the face of the stop is constructed of anti-friction material.

* * * * *

UNITED STATES PATENT AND TRADEMARK OFFICE

CERTIFICATE OF CORRECTION

PATENT NO. : 4,300,327

DATED : November 17, 1981

INVENTOR(S) : William L. Bridger

It is certified that error appears in the above-identified patent and that said Letters Patent are hereby corrected as shown below:

Column 7, line 62, change "225" to ---255---;

Column 13, line 57, between "axes" and "200", insert ---34 and---;

Column 14, line 7, delete "side" and insert ---sides---.

Signed and Sealed this

*Twenty-sixth* Day of *January 1982*

[SEAL]

*Attest:*

GERALD J. MOSSINGHOFF

*Attesting Officer*

*Commissioner of Patents and Trademarks*